US005361859A

United States Patent [19]

Tibbitts

[11] Patent Number: 5,361,859

[45] Date of Patent: Nov. 8, 1994

[54] EXPANDABLE GAGE BIT FOR DRILLING AND METHOD OF DRILLING

[75] Inventor: Gordon A. Tibbitts, Salt Lake City, Utah

[73] Assignee: Baker Hughes Incorporated, Houston, Tex.

[21] Appl. No.: 17,150

[22] Filed: Feb. 12, 1993

[51] Int. Cl.[5] ..... E21B 10/62

[52] U.S. Cl. ..... 175/286; 175/289; 175/384

[58] Field of Search ..... 175/263, 265, 284, 288, 175/289, 291, 292, 384

[56] References Cited

U.S. PATENT DOCUMENTS

| | | | |
|---|---|---|---|
| 1,156,147 | 10/1915 | Karns | 175/291 |
| 1,189,560 | 7/1916 | Gondos . | |
| 1,360,908 | 11/1920 | Everson . | |
| 1,468,509 | 9/1923 | Overman . | |
| 1,500,001 | 7/1924 | Rogers | 175/384 X |
| 1,663,048 | 3/1928 | Hartson . | |
| 1,838,467 | 12/1931 | Stokes . | |
| 1,944,556 | 1/1934 | Halliday et al. . | |
| 2,743,906 | 5/1956 | Coyle . | |
| 2,809,016 | 10/1957 | Kammerer | 175/271 X |
| 2,815,932 | 12/1957 | Wolfram | 175/289 X |
| 3,817,339 | 6/1974 | Furse | 175/271 |
| 4,031,972 | 6/1977 | Burg | 175/263 |
| 4,354,559 | 10/1982 | Johnson | 175/71 |
| 4,386,669 | 6/1983 | Evans | 175/269 |
| 4,431,065 | 2/1984 | Andrews | 175/269 |
| 4,565,252 | 1/1986 | Campbell et al. | 175/269 |
| 4,589,504 | 5/1986 | Simpson | 175/267 |
| 4,651,837 | 3/1987 | Mayfield | 175/262 |
| 4,809,793 | 3/1989 | Hailey | 175/265 |
| 4,842,081 | 6/1989 | Parant | 175/23 |
| 4,846,290 | 7/1989 | Jones | 175/269 |
| 5,074,366 | 12/1991 | Karlsson et al. | 175/76 |

FOREIGN PATENT DOCUMENTS

| | | | |
|---|---|---|---|
| 330433 | 6/1930 | United Kingdom . | |
| 973790 | 10/1964 | United Kingdom . | |
| 2003211 | 3/1979 | United Kingdom . | |
| 2031481 | 4/1980 | United Kingdom . | |
| 836333 | 6/1981 | U.S.S.R. | 175/384 |

*Primary Examiner*—David J. Bagnell
*Attorney, Agent, or Firm*—Trask, Britt & Rossa

[57] ABSTRACT

A drill bit for use with earth drilling equipment, the drill bit having a body and movable cutting members or blades variably positionable between a first position in which the diameter defined by the cutting members is generally equal to or less than the diameter of the drill bit body and a second position in which the diameter defined by the cutting members is greater than the diameter of the drill bit body. The second, expanded position is assumed by the cutting members when they are in contact with the bottom of a hole and are thereby urged upwardly relative to the bit body. The first, retracted position is assumed by the cutting members when the drill bit is being tripped into or out of the hole and, because the cutting members are essentially retracted relative to the bit body, the drill bit does not become jammed downhole. A fixed-blade adaptation of the invention is also contemplated.

21 Claims, 11 Drawing Sheets

EXPANDABLE GAGE BIT FOR DRILLING AND METHOD OF DRILLING

BACKGROUND OF THE INVENTION

1. Field of the Invention

This invention relates generally to drill bits used in drilling subterranean wells or in core drilling of such wells. The invention relates specifically to drill bits having a variable effective diameter which facilitates placement of the drill bit downhole and retrieval thereof. The drill bit of the present invention is particularly suitable for passing through narrow spots in the well bore, sluffing spots and through casing to drill an expanded well bore therebelow. The invention may also be employed in drill bits having replaceable blades.

2. State of the Art

Equipment for drilling into the earth is well-known and long established in the art. The basic equipment used in drilling generally includes a drill bit attached to the bottom-most of a string of drill pipe and may include a motor above the drill bit for effecting rotary drilling in lieu of or in addition to a rotary table or top drive on the surface. In conventional drilling procedures, a pilot hole for the setting of surface casing is drilled to initiate the well. A smaller drill bit is thereafter placed at the bottom of the pilot hole surface casing and is rotated to drill the remainder of the well bore downwardly into the earth.

Many types and sizes of drill bits have been developed especially to accommodate the various types of drilling which are done (e.g., well drilling and coring). A drill bit typically comprises a body having a threaded pin connector at one end for securement to a drill collar or other drill pipe, a shank located below the pin, and a crown. The crown generally comprises that part of the bit which is fitted with cutting means to cut and/or grind the earth. The crown typically has portions designated as the chamfer (the portion below the shank which flares outwardly from the shank), the gage (the annular portion of the cutting means below the chamfer which is usually concentric with the shank), the flank (a tapered portion of the cutting means below the gage), and the nose (the bottom-most portion of the cutting means and that which acts upon the bottom of the hole).

Drill bits include cutting elements for cutting the earth. The two major categories of drill bits are diamond drag bits, which have small natural diamonds or planar or polyhedral synthetic diamonds secured to certain surfaces of the bit body, and roller cone bits, which typically comprise at least two rotatable cones having carbide or other cutting elements disposed on the surfaces thereof. From time to time, the cutting elements of any drill bit become dull and must be replaced or the bit itself replaced. During drilling operations, drilling fluid or mud is pumped down into the hole to facilitate drilling and to carry away formation cuttings which have been cut away by the cutting elements.

From time to time during drilling of a well, the drilling activity will stop for a number of reasons. For example, another length or joint of drill pipe must periodically be added to the drill string in order to continue drilling. At other times drilling will stop because the drill bit may become lodged or jammed downhole, or the drill bit will have become dulled and will need to be replaced. In response to any of these scenarios, the drill bit must be brought out of the hole to either diagnose the reason for the stoppage or to replace the old, worn cutting elements with new elements.

It frequently occurs that when a drill string is tripped or brought out of a hole, the bit will become jammed downhole because of an encounter with debris or with an irregularity in the wall of the hole. Jamming is particularly prevalent when the well bore includes a non-vertical segment, either inadvertently or by design, such as during highly deviated or horizontal drilling. In the former case, during drilling, the bit may wander or move temporarily from a strictly vertical orientation resulting in a hole which curves away from the vertical. A phenomenon of this type, particularly where the departure from the vertical is abrupt, may be known as a "dog leg." In the latter instance, the well bore is caused to depart from the vertical by use of a whipstock or by directional or navigational drilling bottom hole assemblies. In both cases, because of the curvature of the hole, tripping a state of the art drill bit in or out of the hole is often time-consuming or even impossible, in the latter instance necessitating the severance of the drill string at the stuck point, retrieval thereof, setting of a whipstock and drilling a new hole around the remaining portion of the drill string and the bit at the end thereof.

In some instances, due to drill bit cutter damage or unusual formation characteristics, bore holes may be drilled which are "under gage" (i.e., having an undersize diameter in comparison to the design diameter or gage diameter of the drill bit), or out of round as well as undergage. Subsequent removal of the drill string and, in particular, the bit in such situations is difficult to effect.

Thus, it would be an improvement in the art to provide a drill bit which includes cutting means which are variably positionable to expand to full or design gage while downhole and in an operative drilling mode, and to retract when raised in the hole to facilitate tripping the drill bit in and out of the hole.

It would also be an improvement to provide a drill bit which will pass through a smaller diameter well bore or casing and drill a larger, expanded diameter hole therebelow.

Expandable cutting means associated with drilling equipment have been known for many years, but such expandable cutting means have been directed to solving other problems encountered in drilling procedures. For example, expandable cutters attached to a drilling sub and located intermediate to the drill string have been used as apparatus to underream previously drilled holes. Underreaming is a procedure well-known in the drilling industry to enlarge a portion of a previously drilled hole below a point of restriction. Thus, underreaming apparatus are used to enlarge holes below a casing in order to place the next length of casing (See, e.g., U.S. Pat. No. 1,944,556 to Halliday, et al.; U.S. Pat. No. 2,809,016 to Kammerer; U.S. Pat. No. 4,589,504 to Simpson) or to enlarge a previously drilled pilot hole in preparation for insertion of explosives therein (See, e.g., U.S. Pat. No. 4,354,559 to Johnson; U.S. Pat. No. 3,817,339 to Furse).

Drill bit assemblies directed to drilling a well bore have been designed in which the cutting means grind out a diameter exceeding the diameter of the drill bit body or drill string. For example, in U.S. Pat. No. 1,468,509 to Overman, a wedge-shaped drill bit has corresponding slips which dovetail with the drill bit so that when the bit is lowered to the bottom, the slips slide upwardly to come into complementary registration with the body of the drill bit. Drill rollers designed to finely crush or comminute the material in the bottom of the hole are positioned at a slight angle to a central longitudinal bore so that as the rollers turn, they drill out a diameter of earth slightly larger than the diameter of the drill bit. The rollers of Overman, however, do not expand outwardly from a vertical axis to achieve a diameter significantly in excess of that of the drill bit. Further, the elongated design of the Overman device would be disadvantageous in curved well conditions.

In U.S. Pat. No. 1,838,467 to Stokes, a drill bit assembly includes two cutter blades positioned within a bit head, both cutter blades moving from a retracted position within the bit head to an expanded position relative to the bit head when a spring biased plunger is forced downwardly to engage the cutter blades. Upward motion on the bit carrier housed within the bit head urges the plunger upwardly to move the cutter blades into a retracted position for tripping out of the hole.

Expandable cutter means in the prior art have not been specifically developed to facilitate easy removal of the drill bit from a hole, particularly under special drilling conditions such as non-vertical or curved holes. Therefore, it would be an improvement in the art to provide cutting means associated with a drill bit which are appropriately expandable and retractable under all drilling conditions and which do not require complex subassemblies within the bit head.

SUMMARY OF THE INVENTION

A drill bit is provided which has a body and cutting means associated therewith which move between a first position effecting a smaller diameter relative to the diameter of the body and a second position effecting a larger diameter relative to the diameter of the body, the larger diameter comprising the effective gage of the drill bit. The movable cutting means advance from the first, retracted position to the second, expanded position as a result of pressure applied to the bottom or leading end of the cutting means. Such pressure is provided by the weight of the drill string or by a mechanism used to advance the drill string in the hole (common in horizontal drilling) when the drill bit is placed downhole and the movable cutting means come to rest on the bottom of the hole. When the drill bit is raised, the movable cutting means retract from the second position to the first position, thereby effecting a gage diameter equal to or smaller than the bit body to facilitate removal of the drill bit from the hole.

The body of the present invention is structured to retain the movable cutting means in slidable association therewith. Particularly suitable structure of the body includes the formation of channels in the face of the body sized to receive a portion of the movable cutting means therein to facilitate slidable movement of the cutting means relative to the body.

The outer configuration of the body is adapted to facilitate movement of the cutting means from a first position effecting a smaller diameter to a second, expanded position effecting a larger diameter. A particularly suitable configuration for the body is one generally having a conical shape with a top portion having a diameter approximately equal to or slightly larger than that of the drill pipe and a lower portion tapered toward the nose of the drill bit.

The cutting means may be of any suitable size, shape or dimension provided that the cutting means are movable, relative to the body, to effect a gage diameter greater than that of the drill pipe. One suitable configuration for the cutting means of the invention is a blade or wing. The cutting means may preferably include a portion thereof which is slidably disposable within a channel formed in the body of the drill bit. The cutting means further includes cutting elements which may be either conventional carbide teeth, natural or synthetic diamonds of any configuration, or other suitable cutting elements known in the art.

The drill bit of the present invention may be used in connection with both well drilling and core drilling. When used in connection with well drilling, the body further includes secondary cutting means which are secured to the bottom of the body centered with the longitudinal axis of the drill bit. The secondary cutting means is configured to allow unobstructed movement of the movable cutting means between the first and second position. The secondary cutting means include cutting elements which may be carbide teeth, diamonds or other suitable cutting elements known in the art. When the drill bit of the present invention is used in connection with core drilling, the movable cutting means are positioned about a central opening in the nose at the bottom of the body which allows the cut core to enter into the inner bore of a core barrel above the bit.

It is also contemplated that the drill bit design of the present invention may be employed in a drill bit having slidably insertable blades or wings which are then fixed to the bit body, and which may subsequently be removed for repair or replacement. It is also contemplated that this embodiment of the invention affords the ability to fabricate bits of various diameters within certain size or gage ranges by adjusting the position of the blades with respect to the bit body prior to affixation thereto.

BRIEF DESCRIPTION OF THE DRAWINGS

In the drawings, which illustrate what is currently considered to be the best mode for carrying out the invention.

DETAILED DESCRIPTION OF THE PREFERRED EMBODIMENTS

Figure 1:
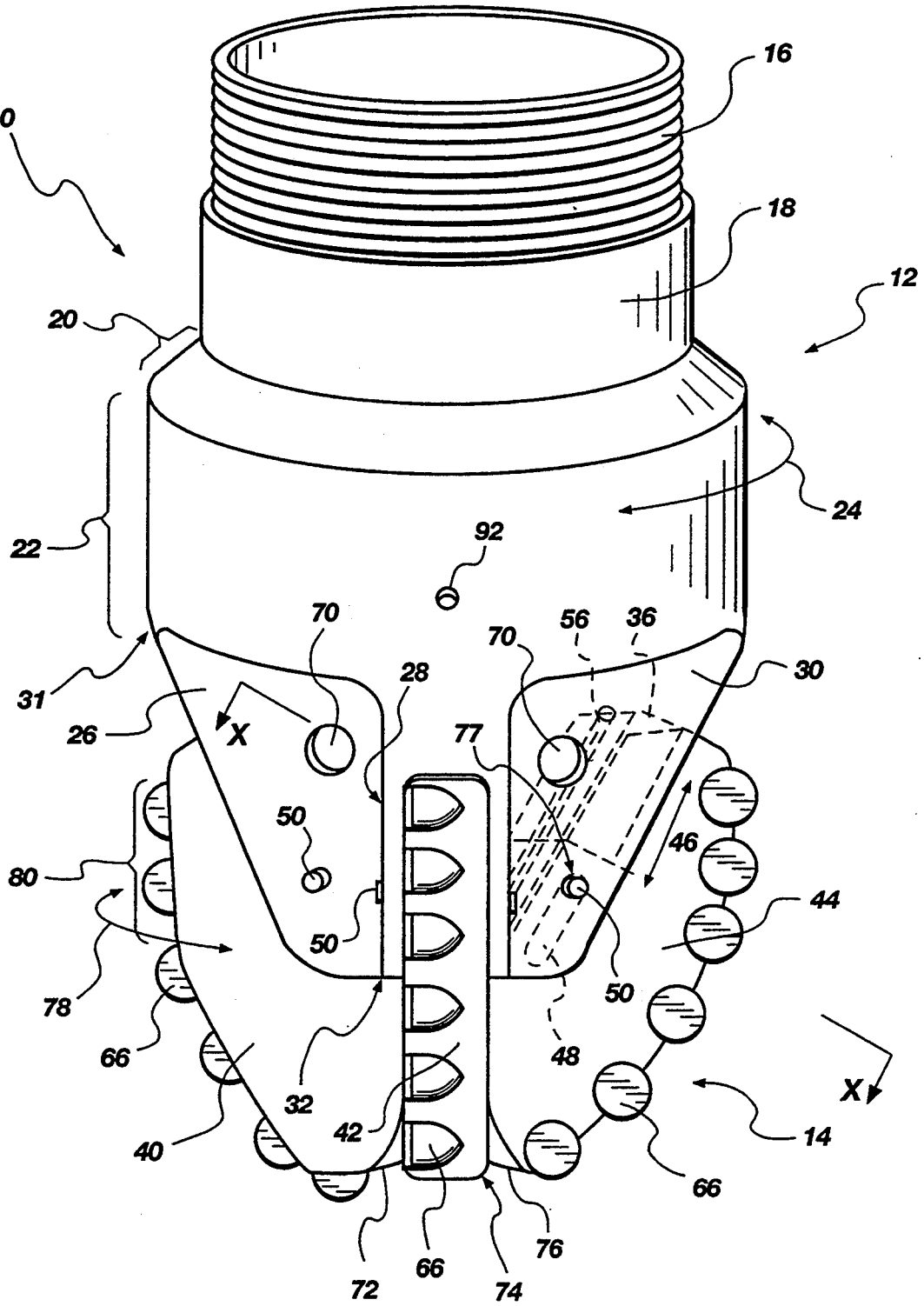
FIG. 1 is an elevational view of a first preferred embodiment of the drill bit of the invention illustrating the cutting means in the first position.

A first preferred embodiment of the drill bit of the present invention, generally indicated by reference numeral 10 in FIG. 1, includes a body 12 and cutting means 14 associated therewith. The drill bit is attachable to the downhole end of conventional drilling apparatus (not shown) such as a string of drill pipe, drill collar or other drilling sub element, including without limitation the output shaft of a downhole motor. The drill bit 10 may be attached to the drilling apparatus by means of a threaded pin connector 16. Below the pin connector 16 is the shank 18 of the drill bit 10, and below the shank 18 is the chamfer 20.

The outer body diameter 22 of the drill bit 10 generally defines the outermost circumference 24 of bit body 12, which in conventional bits would also define the gage of the bit. However, in the drill bit 10 of the present invention, the bit body 12 is structured to permit variable positioning of movable cutting means 14 between a first, retracted and a second, expanded position, the former in most cases defining a diameter no larger than that of bit body 12, while the latter defines a substantially larger diameter. The second, expanded position of cutting means 14 defines the gage or working diameter of the bit 10 of the present invention. The bit body 12 may preferably be structured to taper inwardly (see FIG. 1) from the outer body diameter 22, the inward taper in combination with the cutting means 14 in the retracted position facilitates lowering the drill bit into the hole, a process commonly known as "tripping in," and facilitates removal of the drill bit from the hole, a process commonly known as "tripping out."

In one exemplary embodiment illustrated by FIG. 1, the bit body 12 is configured with three columns 26, 28, 30 each of which serves to support cutting means 14. The columns 26, 28, 30 extend from the bottom edge 31 of the outer body diameter 22 to the nose 32 of the bit body 12 and are tapered inwardly from the outer body diameter 22 to the nose 32. Each column 26, 28, 30 has formed therethrough a channel 36, shown in phantom, in which a portion of the cutting means 14, designated as blades or wings 40, 42, 44 is slidably positioned.

As suggested in phantom line by FIG. 1, the blade 44 may move upwardly and downwardly in the channel 36 in the directions shown at 46. Blades 40 and 42 are similarly movable in cooperating channels. As further suggested in phantom line by FIG. 1, each blade (44 serving as an example) has a slot 48 formed through the thickness thereof and a positioning pin 50, inserted laterally through each column 26, 28, 30 fits within the slot 48 of the blade. Each blade 40, 42, 44 is therefore maintained within its respective channel by the pin 50. The movement of each blade 40, 42, 44 in its respective channel 36 is dictated by the traverse of the pin 50 in the slot 48. It will of course be understood that bit body 12, and specifically columns 26, 28 and 30 may be slotted instead of blades 40, 42 and 44, the latter carrying pins to cooperate with the slotted columns.

Figure 2:
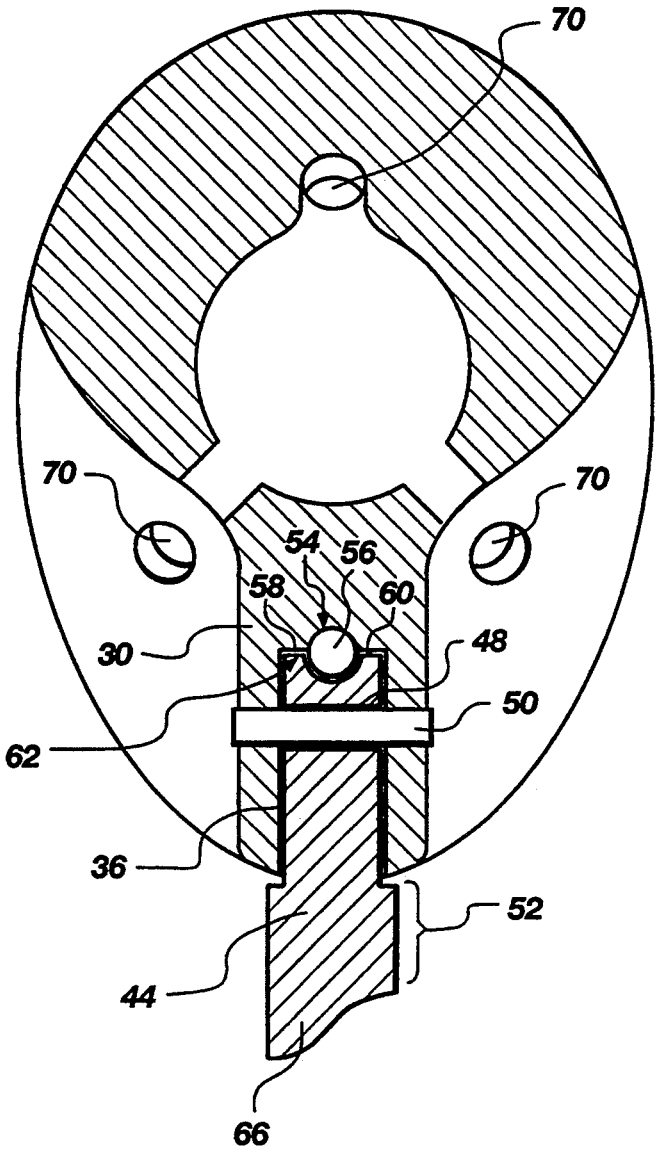
FIG. 2 is a view in cross section of the drill bit taken at line X—X of FIG. 1.

The relationship of the blade 44, channel 36, slot 48 and pin 50 may be more completely understood by reference to FIG. 2 which illustrates a cross section of the bit body 12 of FIG. 1 taken at line X—X thereof. It can be seen that pin 50 extends laterally through the column 30 and through the slot 48 formed through the blade 44. It may also be seen that the portion 52 of the blade 44 which extends outwardly from the column 30 may be slightly broader than the portion of the blade 44 which is positioned within the channel 36. This configuration of the blade 44 helps prevent debris from entering channel 36.

Bearing means 54 may be associated with each channel 36 to facilitate movement of the blade 44 therewithin. As illustrated by FIG. 2, the bearing means 54 may be a cylindrical rod 56 formed or secured in the bottom 58 of the channel 36 which cooperates with a reciprocating race 60 formed along the inward face 62 of the blade 44. Thus, as the blade 44 slides within the channel 36, race 60 of the blade 44 slides over rod 56 to provide ease of movement. Alternatively, rod 56 may be replaced by a plurality of balls, either closely or loosely placed in a race or groove in body 12.

The cutting means 14 of the drill bit 10 may be sized and configured in any manner which provides an appropriate cutting profile. By way of illustration, the blades 40, 42, 44, shown by FIG. 1, may be disk-like, having a portion positioned within a channel of the bit body 12 and a portion which extends away from the bit body 12. The portion which extends outwardly from the bit body 12 has cutting elements 66 associated therewith, such as carbide bits shown in FIG. 1. The type of cutting element 66 used in connection with the cutting means 14 may be any of the conventional types known in the art, such as natural or synthetic diamonds, and the like. What material of cutting element 66 is optimal for use, and the configuration of the cutting means 14, is determined by the type of drilling desired and the particular characteristics of the earth formation being drilled. It is preferable that the cutting elements 66 be fixed to rather than movable (rotating) with respect to the blades.

The drill bit of the present invention may also include apertures 70 formed through the bit body 12 to provide passage of drilling fluid, or mud, to the face of the cutting means 14. That is, drilling fluid is typically pumped downwardly through the drill pipe into passages or a central plenum in bit body 12 and exits through apertures 70, commonly known as nozzles. The apertures 70 are formed in the bit body 12 at an angle which specifically trains a jet of fluid to the face and cutting elements 66 of each blade to keep debris from becoming lodged against or between the cutting elements 66, to cool the cutting elements 66 and to remove debris from the bottom of the well bore and up the exterior of the drill string.

As illustrated, the drill bit 10 of the present invention provides movable cutting means 14 which are movable from a first retracted position, effecting a diameter resulting in a circumference 78 defined by rotation of the cutting means 14 which is equal to or less than the diameter and circumference 24 of the outer diameter 22 of the body 12 of drill bit 10 (see FIG. 1), to a second expanded position effecting a diameter resulting in circumference 78' which is greater than the circumference 24 of the outer diameter 22 of body 12 (see FIG. 3) and which defines the working gage of drill bit 10 when drilling. As illustrated by FIG. 1, when the drill bit 10 is being tripped in or out of the hole, gravity and drag on the well bore wall acts upon the blades 40, 42, 44 to draw the blades downwardly. In being drawn downwardly, the lower edges 72, 74, 76 of the blades 40, 42, 44 converge together, and each blade is suspended within its respective channel by registration of the pins 50 against the upper end 77 of each corresponding slot 48 and by mutual contact at the nose of the bit.

When the drill bit 10 is being tripped in or out of the hole, and thus the blades 40, 42, 44 are drawn downwardly, the circumferential distance 78 around the outer gage portion 80 of blades 40, 42, 44 is equal to or less than the circumferential distance 24 around the outer body diameter 22 of the drill bit 10. Comparison of the outer body diameter 22 of the drill bit 10 to the outer extent 80 of the blades during tripping may be seen in FIG. 4, which illustrates a cross section of blade 44 shown in FIG. 7. Because the blades are retracted when the drill bit 10 is travelling through the hole, the blades 40, 42, 44 cannot easily become lodged on any material or formation in the hole and cannot become Jammed downhole.

Figure 3:
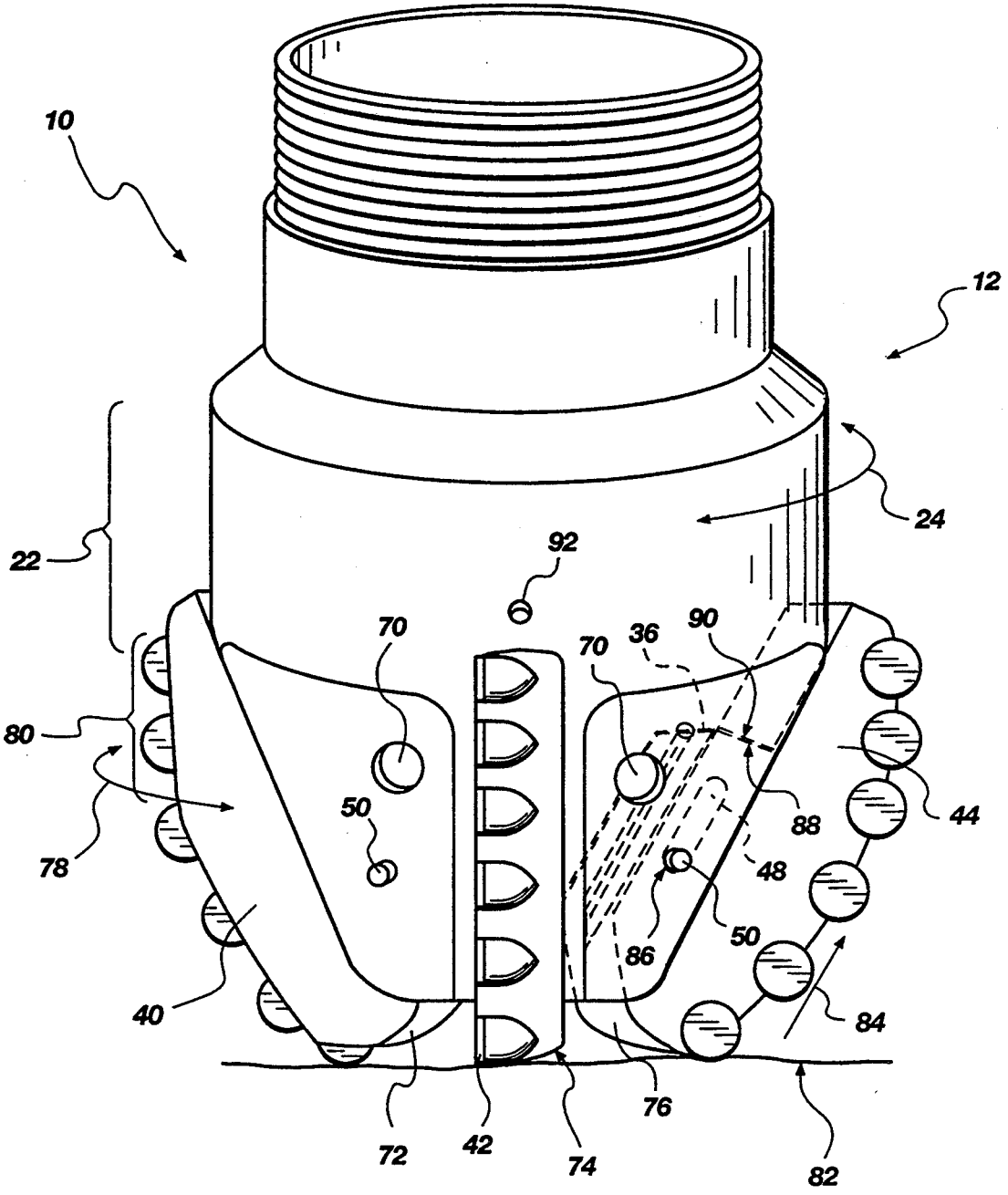
FIG. 3 is an elevational view of the drill bit illustrating the cutting means in the second, expanded position.

As shown in FIG. 3, when the drill bit 10 is tripped into the hole, the lower edges 72, 74, 76 of the blades 40, 42, 44 eventually come into contact with the bottom of the hole 82. Contact of the blades 40, 42, 44 with the bottom of the hole 82 results in force being applied to the lower edges 72, 74, 76 of the blades 40, 42, 44 and the blades are urged upwardly, and radially outwardly in direction 84, until each pin 50 comes into a position proximate the lower end 86 of each slot 48. At the same time, the upper edge 88 of the blade 44 positioned within the channel 36 comes into registration with the upper end 90 of the channel 36 thereby preventing further upward and outward movement of the blade 44 in the channel 36, and shearing of pin 50. The relationship of the blade 44 to the channel 36 may be more easily understood by reference to FIG. 5.

While the drill bit 10 of the present invention is illustrated as having a retracted position wherein the cutting means 14 define a diameter which is less than outer diameter 22 of body 12, it should be understood that the retracted cutting means 14 may initially define a larger diameter than body 12, and extend even farther radially outwardly from body 12 in an expanded position.

Figure 4:
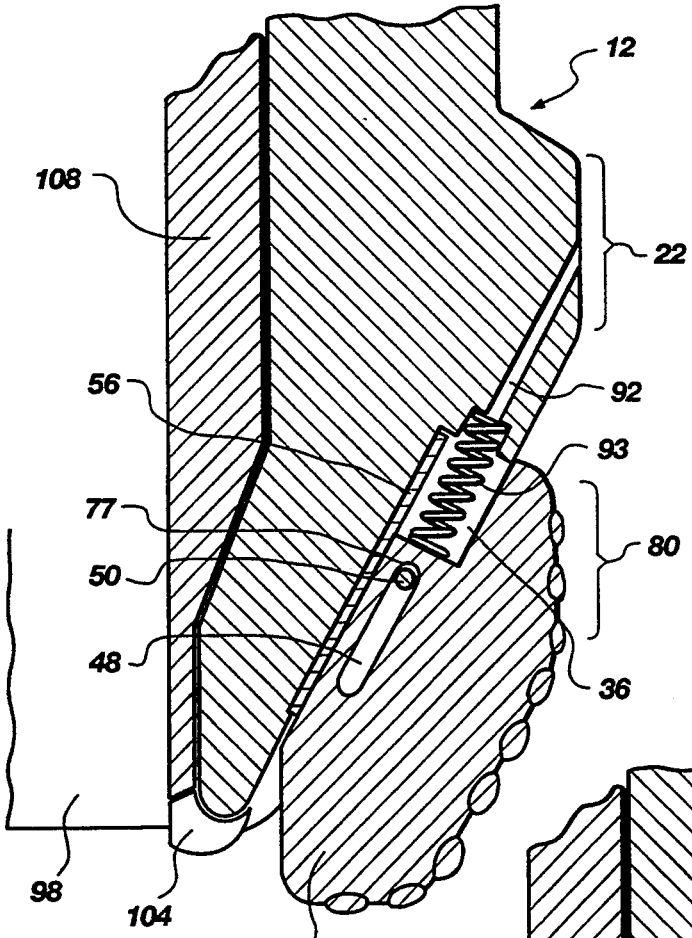
FIG. 4 is a partial view of a core bit in cross section illustrating the cutting means in the first position.
Figure 5:
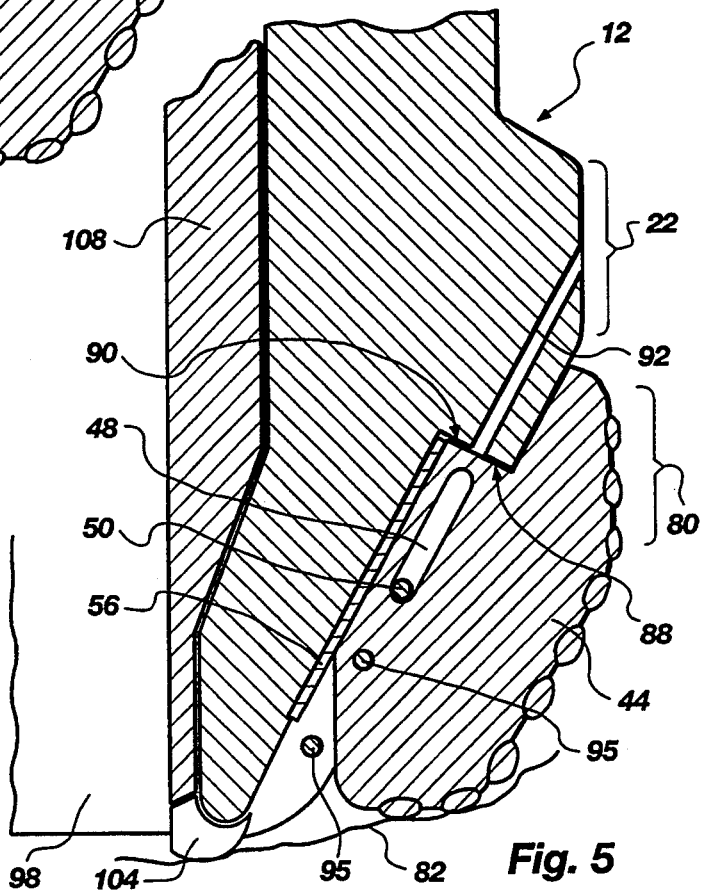
FIG. 5 is a partial view of a core bit in cross section illustrating the cutting means in the second position.

It should also be understood that a blade retention means, such as shear pins, biasing springs, spring-biased ball detents, magnets, leaf drag springs or other means known in the art may be employed to assist in retaining blades 40, 42 and 44 in a retracted position until it is desired to expand them. FIG. 4 depicts a modification employing a coil-type biasing spring 93. FIG. 5 depicts a modification employing a shear pin 95 which has been severed as blade 44 extends. However, such features are not absolutely essential to the basic concept of the invention.

Due to hydrostatic pressure of the drilling fluid in the well bore, there will normally be an accumulation of fluid which has seeped into the channel 36 and which may impede free upward movement of the blades 40, 42 and 44. Therefore, relief apertures 92, shown in FIGS. 4 and 5 with respect to column 30 and blade 44, may be formed through the bit body 12 or the columns 26, 28 and 30 to provide communication of fluid therethrough from the channels 36 to outside the bit body 12.

When the blades 40, 42, 44 are urged upwardly, the circumference 78' defined by the outer gage 80 of the blades 40, 42, 44 during rotation of bit 10 becomes greater than the circumference 24 of the outer body diameter 22 of the drill bit 10, as illustrated by FIGS. 3 and 5. Rotation of the drill bit 10 during drilling therefore results in a hole being drilled of a gage or diameter which is greater in diameter than the outer body diameter 22 of the body 12 of drill bit 10. It can be readily understood, therefore, that when drilling ceases and the drill bit 10 is tripped out of the hole, the blades 40, 42, 44 slide downwardly and radially inwardly, as shown in FIG. 1, assuming a smaller circumference 78 so that the drill bit 10 can be easily removed from the hole.

The principles of the present invention are applicable to well drilling operations as well as core drilling operations. More specifically, in well drilling operations, the objective is to drill a hole into the earth to access underground reserves of minerals or fluids such as oil. In well drilling operations, therefore, it is necessary to provide cutting means which act upon the center of the very bottom as well as the radially outer area of the bottom of the hole in the drilling thereof. Thus, when used in well drilling operations, the present invention includes a secondary cutting means 94, illustrated in FIG. 6, positioned at the nose 32 of the drill bit 10. The secondary cutting means 94 has cutting elements 96 associated therewith which, in conjunction with the cutting elements 66 positioned on the lower edges 72, 74, 76 of the blades 40, 42, 44, act upon the bottom-most surface of the hole.

Figure 6:
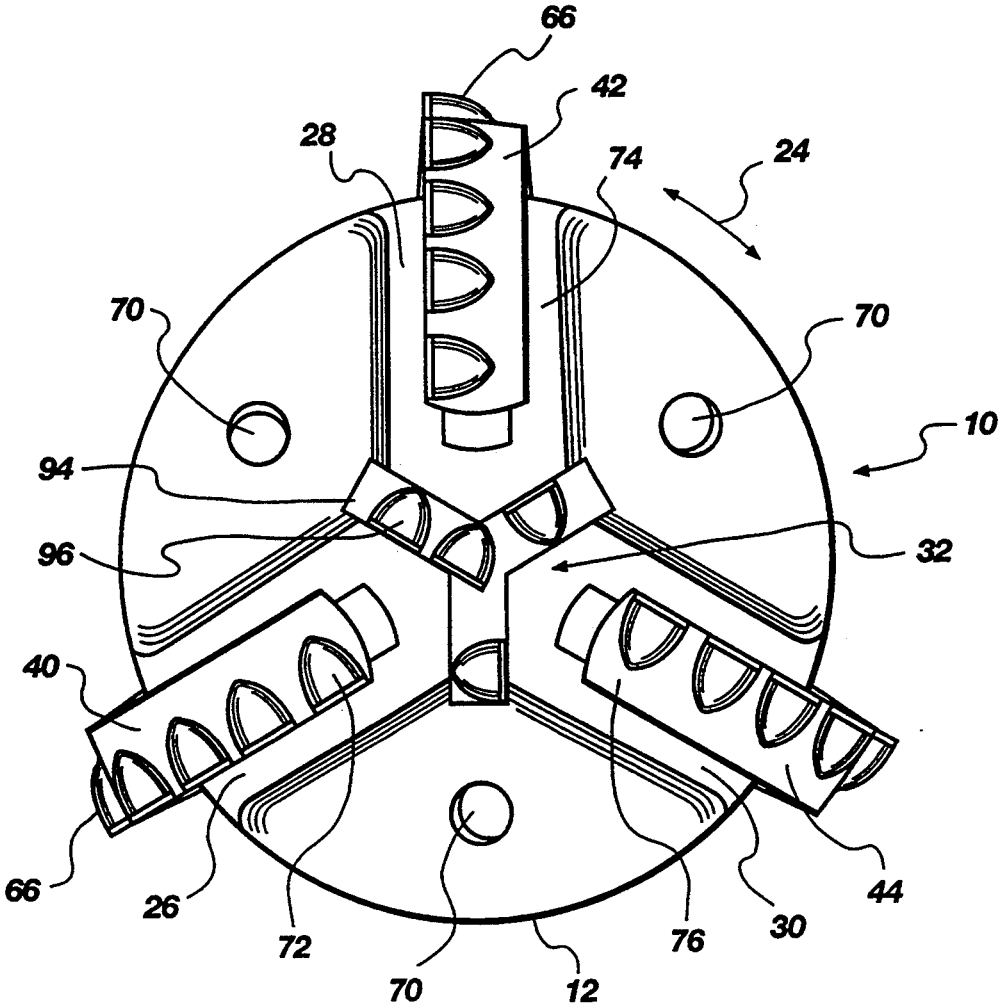
FIG. 6 is a plan view of the bottom of a drill bit of the present invention used in well drilling depicting both cutters fixed directly to the bit body and cutters fixed to movable portions of the bit crown.

The secondary cutting means 94 may take any shape or form which provides suitable cutting action against the bottom of the hole but which does not obstruct movement of the blades 40, 42, 44 when they are drawn downwardly, such as when being tripped in and out of the hole. An exemplary configuration of the secondary cutting means 94 is illustrated in FIG. 6. Notably, the blades 40, 42, 44 in FIG. 6 are shown in the second, expanded position pushed outwardly relative to the body 12 of the drill bit 10. However, when the drill bit 10 is being tripped in or out of the hole, the blades 40, 42, 44 converge downwardly toward the secondary cutting means 94 and the secondary cutting means 94 does not impair the movement of the blades 40, 42, 44. Apertures or nozzles 70, which direct drilling fluid downwardly toward the blades 40, 42, 44 during drilling, may also be oriented to remove debris from the secondary cutting means 94.

The principles of the present invention may also be used in connection with drilling apparatus used for drilling cores. Such apparatus typically comprises a drill bit connected to a core barrel which is structured with an inner tube for receiving and retaining a core of earth cut by the drill bit. Drill bits used in core drilling are structured with a central aperture 98 formed in the nose 32 of the drill bit 10, as illustrated in FIGS. 4, 5 and 7.

Figure 7:
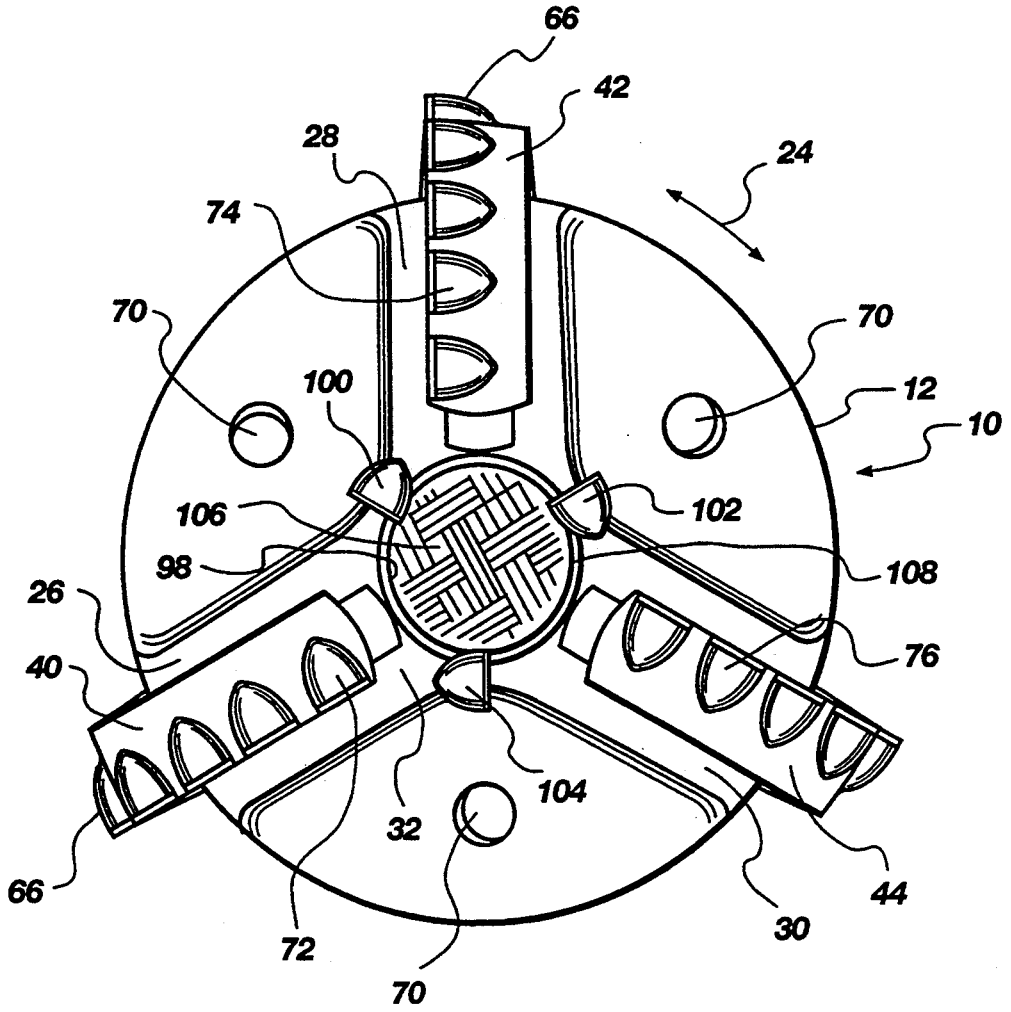
FIG. 7 is a plan view of the bottom of the core bit illustrated in FIGS. 4 and 5.

When a drill bit 10 according to the present invention is used in core drilling, the blades 40, 42, 44 are urged outwardly when the lower edges 72, 74, 76 contact the bottom of the hole, as illustrated by FIGS. 5 and 7. When used in core drilling, the bit body 12 also has core cutter elements 100, 102, 104 which are located radially inwardly of the position of lower edges 72, 74, 76 of blades 40, 42, 44 during coring and which cut in a circular pattern thereby excising a core 106 which moves into the shoe 108, shown in FIGS. 4 and 5, as drilling progresses further down the hole.

Figure 8:
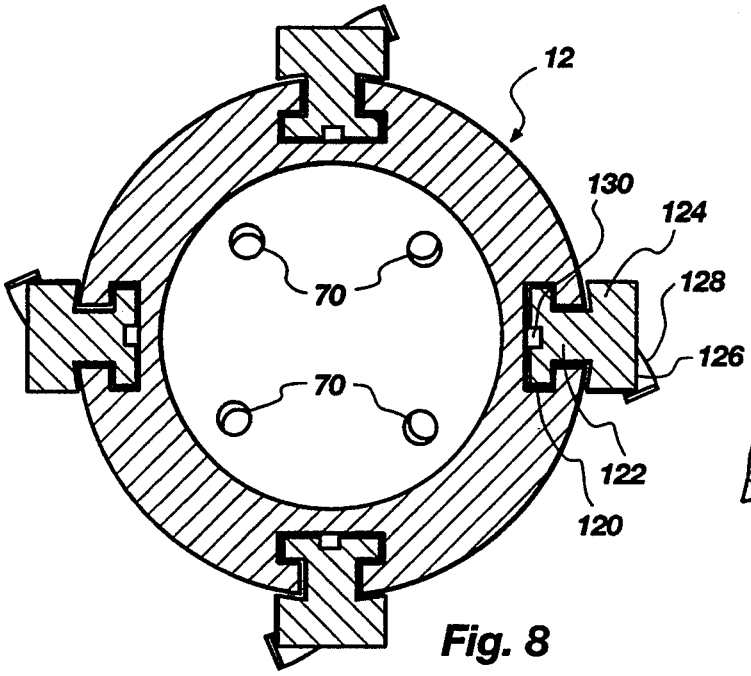
FIG. 8 is a lateral, cross-sectional view of a second preferred embodiment of the present invention.
Figure 10A:
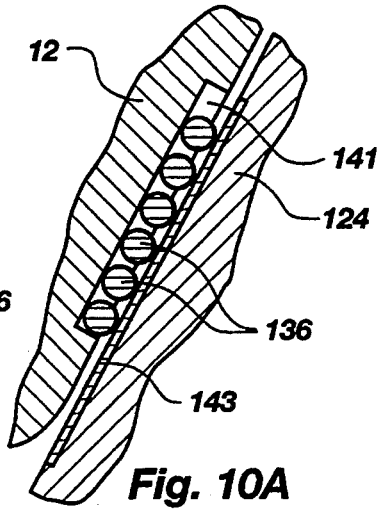
FIG. 10A is a longitudinal, cross-sectional view of an alternative bearing structure employed in the present invention.
Figure 10:
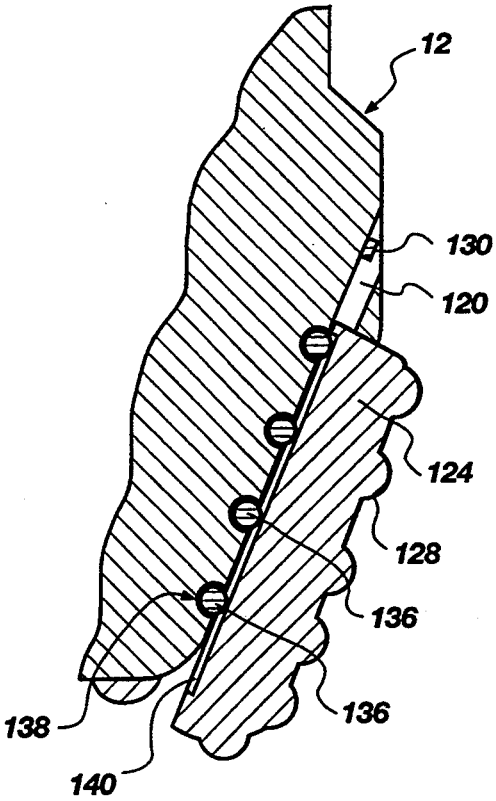
FIG. 10 is a longitudinal, cross-sectional view of the embodiment shown in FIG. 9.
Figure 9:
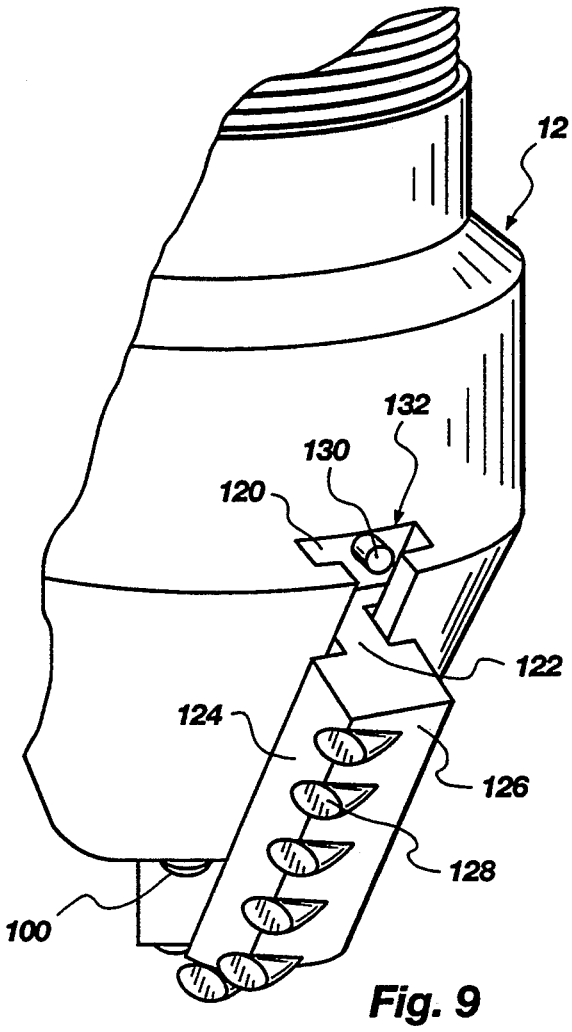
FIG. 9 is a side elevational view of the embodiment shown in FIG. 8.

In another embodiment of the present invention, as illustrated by FIGS. 8, 9 and 10, the bit body 12 may have T-shaped channels 120 formed therein and sized to receive a reciprocating T-shaped member 122 of a blade 124. As illustrated by FIG. 8, there may be a plurality of blades 124, numbering from two to twelve or more for extremely large bits. Secured to the outer face 126 of the blade 124 is a plurality of cutting means 128 for drilling the formation. In this embodiment, the T-shaped channel 120 may have intervention or stop means 130 associated with the upper end 132 thereof to limit the upward movement of the blade. The blade 124 is thereby prevented from exiting the T-shaped channel 120 completely.

As shown by FIG. 10, the movement of the blades 124 in the T-shaped channel 120 may be facilitated by bearing means, shown here as balls 136 cradled in sockets 138 positioned in the bit body 12. The balls 136 may roll within a race 140 formed in the blade 124. When balls 136 are used as the bearing means, there may be a single ball or a plurality of balls 136 as shown in FIG. 10. Moreover, as shown in FIG. 10A, balls 136 may be contained within a recess 141 in bit body 12 and roll on a bearing surface 143 on the blades.

Figure 11:
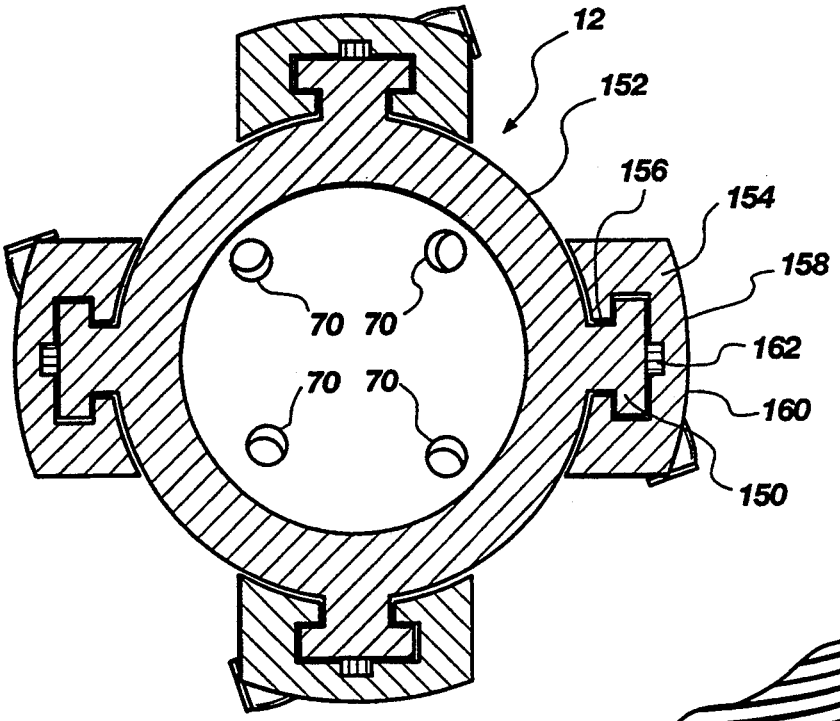
FIG. 11 is a lateral, cross-sectional view of a third preferred embodiment of the present invention.
Figure 12:
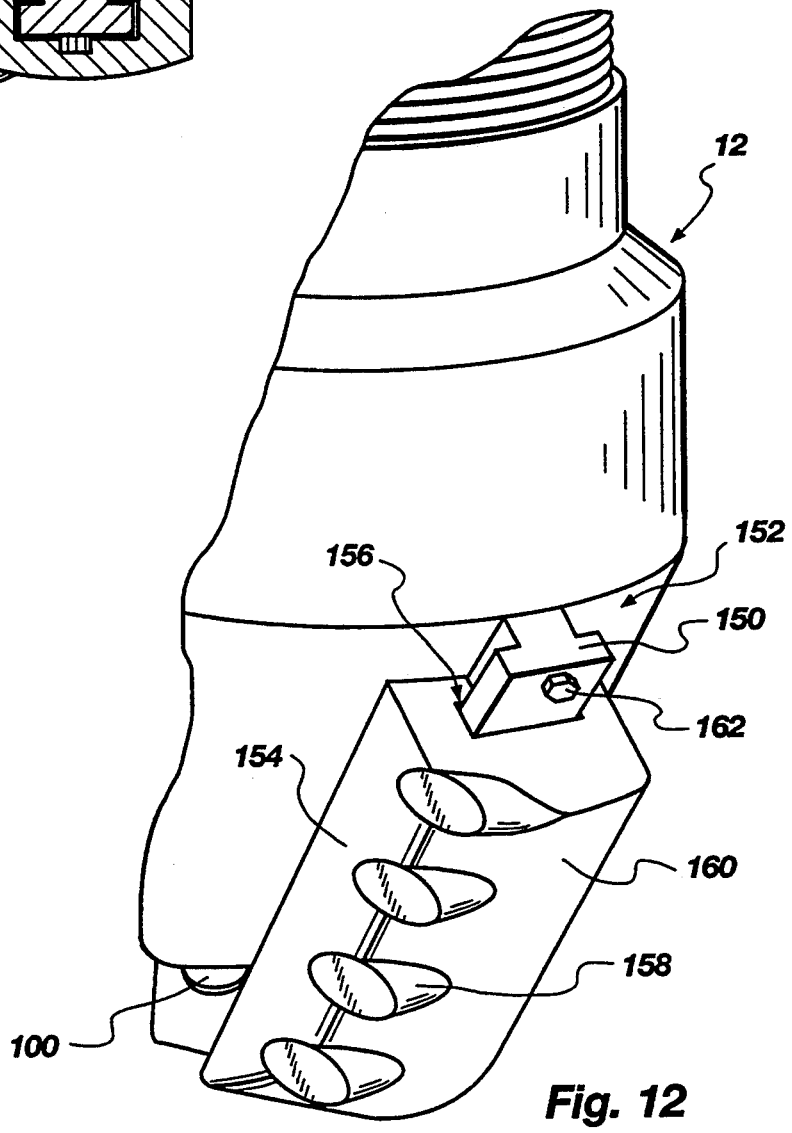
FIG. 12 is a side-elevational view of the embodiment shown in FIG. 11.

In yet another embodiment, as shown by FIGS. 11 and 12, T-shaped rails 150 may be formed on the outer face 152 of the bit body 12. The blades 154 may be configured with a T-shaped channel 156 which is sized to slidably interconnect with the T-shaped rails 150 on the bit body 12. Cutting means 158 are secured to the outer face 160 of the blades 154 for drilling the formation. Intervention or stop means 162, shown in FIG. 12 as a bolt, may be associated with the upper end 164 of the T-shaped rail 150 to limit the upward movement of the blade 154 on the bracket 150.

Figure 13:
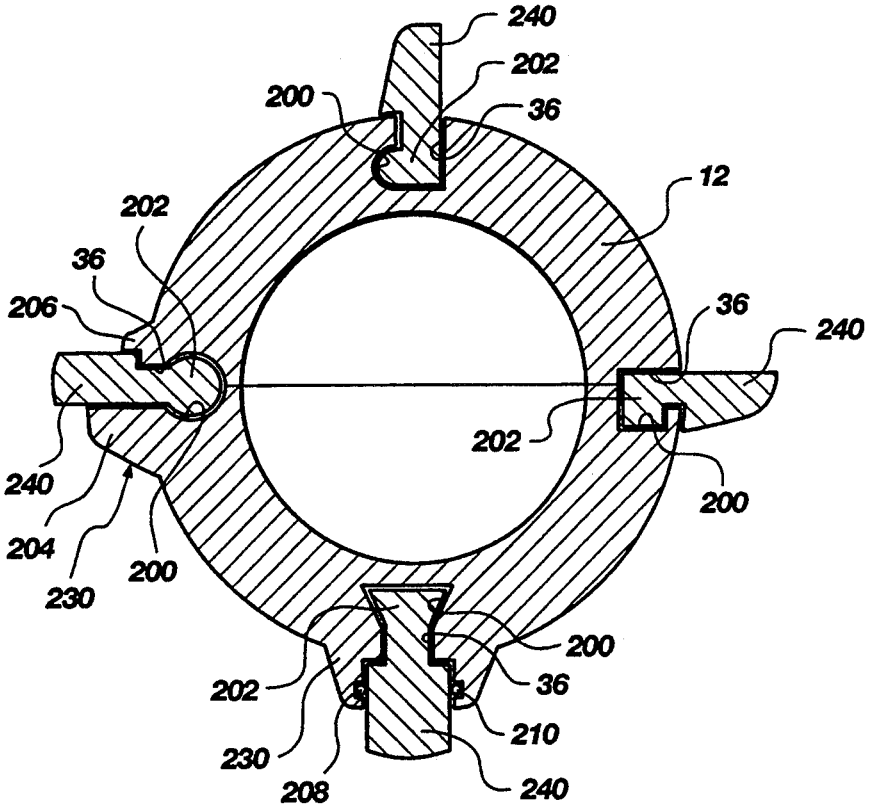
FIG. 13 is a lateral, cross-sectional view of a fourth preferred embodiment of the present invention.
Figure 14:
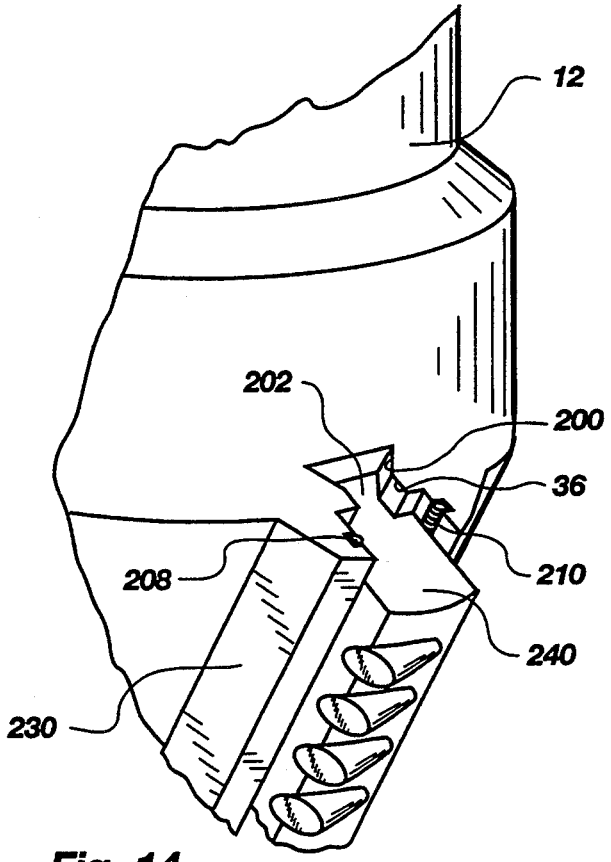
FIG. 14 is a side-elevational view of the embodiment shown in FIG. 13.

Referring to FIGS. 13 and 14 yet another embodiment of the present invention is illustrated. In this embodiment, bit body 12 includes channels 36 which are enlarged at their bases 200 to receive a cooperating enlarged protrusion 202 along the inner extent of blades 240. The cross-sectional configuration for enlarged channel bases 200 and cooperating enlarged protrusions 202 may be of a dovetail cross section or circular, half-circular, rectangular or any other suitable configuration to provide blade retention, as shown for exemplary purposes in cross section in FIG. 13. Such a design eliminates the need for any dedicated bearing structures, although, of course, teflon coatings or brass or other inserts may be used to facilitate blade movement. A pin and slot configuration, as disclosed with respect to the embodiment of FIG. 1, or a stop means, as shown in FIG. 9 may be employed to limit outward travel of blades 240 and thus define the gage of the well bore being drilled.

FIG. 13 also illustrates that the back or trailing side 204 of a column 230 containing a blade 240 may extend radially outwardly farther than the leading side 206 to provide support for the blades against circumferentially or tangentially directed forces caused by rotation of the drilling string and contact with the formation. It should also be noted, as illustrated in FIGS. 13 and 14, that channels 36 may reside in the bit body 12 itself, columns 230 not being required for all applications.

Finally, FIGS. 13 and 14 also show the use of seals 208 and/or 210 between the blades and the inner surfaces of the channels in which they move.

Figure 16:
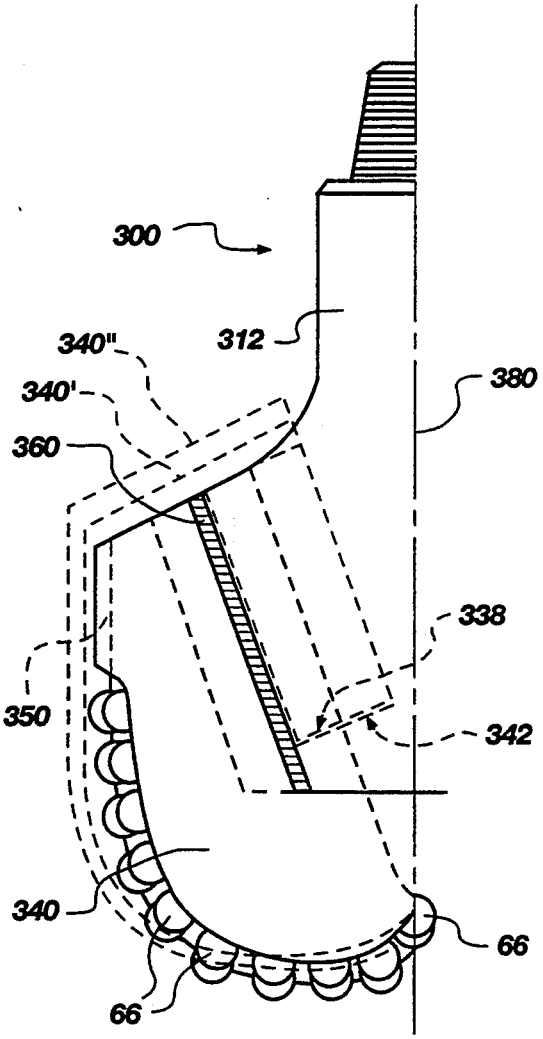
FIG. 16 is a side-elevational view of the drill bit of FIG. 15.
Figure 15:
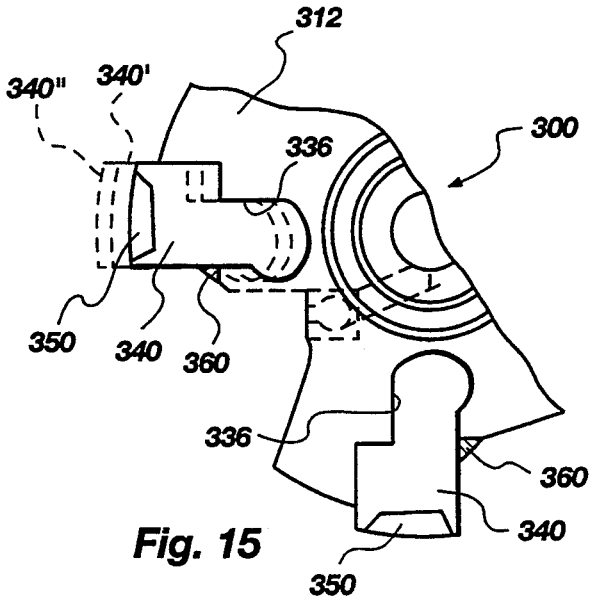
FIG. 15 is a partial lateral, cross-sectional view (looking upwardly) of a drill bit having a fixed, replaceable cutting structure according to the present invention.

The embodiment of FIGS. 15 and 16 illustrates how the principle of the present invention may also be used to enhance the characteristics of a fixed-blade bit. Bit 300 includes channels 336 in body 312. Blades or wings 340 are fabricated separately from body 312, and slide into channels 336 where they are secured by welding, brazing, adhesive bonding or mechanical securement means known in the art such as bolts, screws, pins or keys. Alternatively, body 312 may be heated, blades 340 dropped into channels 336, and body 312 cooled, resulting in shrinkage of body 312 and retention of blades 340 therein. With such an arrangement, damage or wear to a particular blade or cutting elements thereon may be addressed by removal of the damaged blade, repair thereof and reinsertion in body 312 or if the blade is irreparably damaged, by replacement with a new one. Gage pads 350 as well as cutting elements 66 constitute replaceable elements on blades 340.

As shown in FIGS. 15 and 16 by way of example, blades 340 may be secured in body 312 by weld beads 360. Downward movement of blades 340 in channels 336 is arrested by contact of the lower end 342 of each blade key 334 with shoulder 338 in a channel 336. It should be noted that the inner portion of blade key 334 and those of channel 336 are of larger cross section than the intermediate portions, as in the other embodiments of the present invention, to maintain blades 340 within channels 336.

Blades 340 would normally not be identical, in that one channel 336 and cooperating blade 340 are extended so that the cutting elements 66 of that blade 340 cut the very center of the well bore, as shown in FIG. 16, the centerline or axis of bit 312 being designated as 380. Alternatively, a group of cutters may be mounted directly on the nose of the bit to cut the center of the wellbore (see FIG. 6 for such a grouping). With such a design, all of the blades 340 may be made identical, it being understood that even with identical blade size and configuration, the number and location of the cutters 66 of the blades may or may not differ for optimum performance.

Figure 16A:
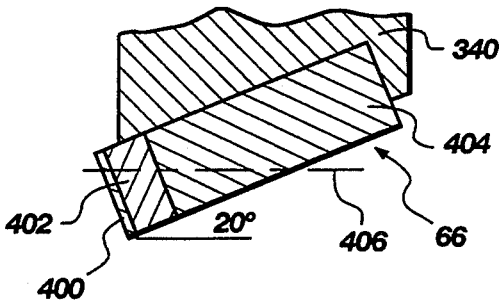
FIG. 16A is an enlarged section of a cutting element as mounted in one of the cutting structures of the bit of FIGS. 15 and 16.

FIG. 16A depicts an exemplary cutting element 66 usable with drill bit 300. Cutting element 66 includes a layer 400 of diamond or other superhard material formed on a metallic substrate 402 (typically WC) and secured to cylindrical carrier element 404 of sufficient length to provide adequate surface area for brazing or otherwise bonding element 66 to blade 340. Further, as shown in FIG. 16A, the length of carrier element 404 provides continued bond strength throughout the wear life of cutting element 66, until roughly 75% of diamond layer 402 is worn away, shown at line 406 for element 400, disposed at a 20° angle to the axis or centerline 380 of bit 300.

It may also be readily appreciated from perusal of FIGS. 15 and 16 that the present invention as applied in those figures permits an entire size or gage range of bits to be fabricated from a single body size 312, by utilizing different size blades 340. In such a manner, odd-gage sizes may be easily accommodated without inventorying entire bits. Even more preferably, a single size of blades 340 may be employed within a given gage size range, and the blades 340 positioned selectively in channels 336 before affixation therein, the upward or downward change in position effecting a change in gage size (see 340' and 340'') while using the same blade. In such a manner, a six-inch range of bits might be fabricated to extend from a $5\frac{7}{8}$-inch gage size to a $6\frac{3}{4}$-inch gage size, or an eight-inch range of bits might be fabricated to extend from a $7\frac{7}{8}$-inch gage size to a $8\frac{3}{4}$-inch gage size.

Figure 17:
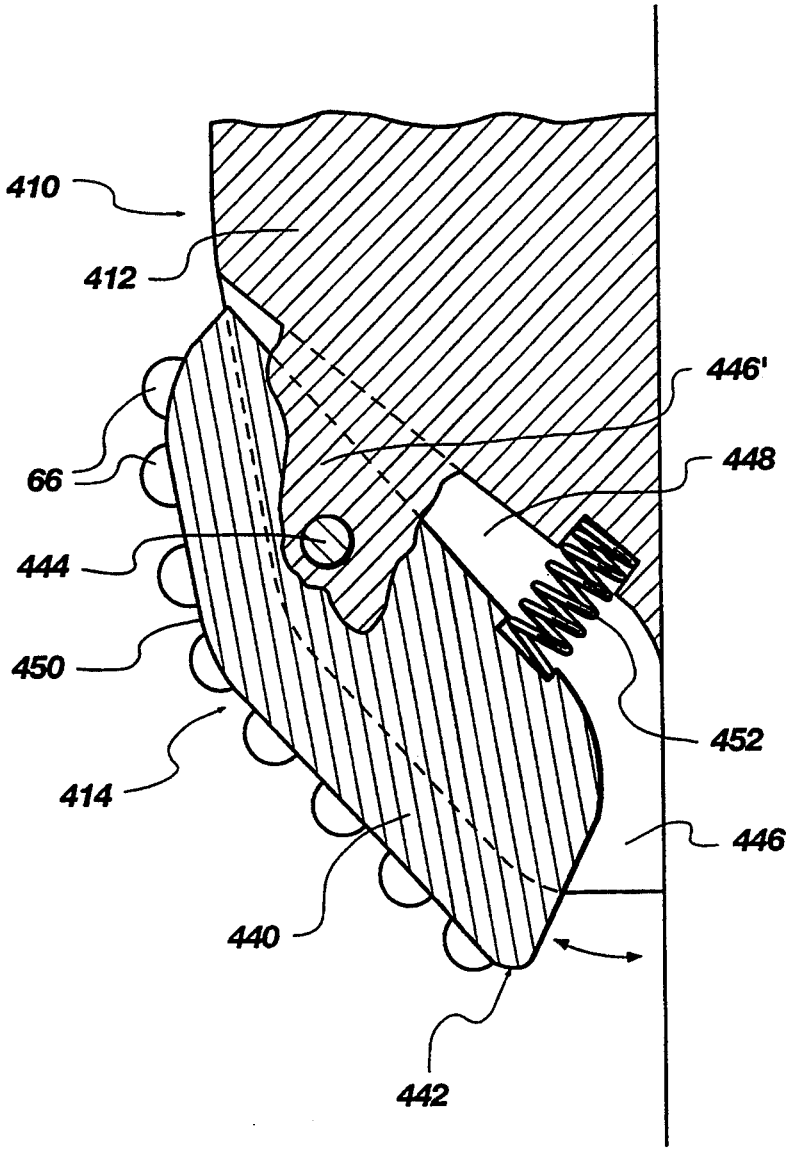
FIG. 17 is an enlarged, partial, quarter-sectional view of a rotationally expandable gage drill bit according to the present invention.

In addition to the previously disclosed embodiments of the invention, it is also contemplated that the cutting means 414 of a drill bit 410 of the present invention may be rotationally expandable from a first retracted position to a second expanded position responsive to contact with the undrilled bottom of the hole, as depicted in FIG. 17. In this embodiment, one or more blades 440 having a leading edge 442 may each be rotatable about a hinge pin 444 which is secured to body 412 at walls 446 and 446' which define a blade recess 448. Upon contact of leading edge 442 with the bottom of the hole, trailing edge 450 of blade 440 will rotate outwardly to an expanded position whereat cutting elements 66 will engage the formation and bit 410 will cut an enlarged bore hole upon rotation of bit 410. Upon withdrawal of drill bit 410 from the hole bottom, blade 440 will retract, the retraction being augmented if desired by a biasing means such as spring 452.

The movable cutting means of the present invention allow the drill bit to be easily tripped in and out of a hole without becoming lodged or jammed downhole. The drill bit of the present invention is thus adaptable to any drilling apparatus and is usable with any kind of drilling technique. Moreover, the discrete body/insertable blade configuration of the present invention is adaptable to an easily repairable fixed-blade drill bit. Further, the drill bit of the present invention is susceptible to use in so-called "anti-whirl" bit designs. Finally, it should be recognized and appreciated that the use of a single movable or retractable blade rather than the multiple retractable blades of the preferred embodiments is contemplated as within the scope of the invention. Such a bit, with a simple movable blade, would be particularly suited to provide the directed side force required for an anti-whirl bit. Thus, reference herein to specific details of the illustrated embodiments is by way of example and not by way of limitation. It will be apparent to those skilled in the art that many modifications of the basic illustrated embodiment may be made without departing from the spirit and scope of the invention as recited by the claims.

What is claimed is:

1. A drill bit for drilling subterranean formations, comprising:

a body having an outer diameter, a nose and an inwardly tapering outer face positioned therebetween;

movable cutting means positioned on said outer face of said body for cutting said formations, said movable cutting means being variably positionable relative to said outer face between a first position effecting a first diameter for said cutting means and a second position effecting a second, larger diameter for said cutting means; and cutting elements associated with said cutting means.

2. The drill bit of claim 1, wherein said first diameter is at most equal to said outer diameter of said body.

3. The drill bit of claim 1, wherein said first diameter is greater than said outer diameter of said body.

4. The drill bit of claim 1, wherein said body is structured with channels having sides open to said outer face, at least a portion of said cutting means being slidably disposed within said channels.

5. The drill bit of claim 4, wherein said cutting means have slots formed through said portion of said cutting means which is disposed within said channels, and further comprising positioning means associated with said body and positioned through said slots formed in said cutting means for limiting said slidable movement of said cutting means.

6. The drill bit of claim 4, further comprising relief aperture means associated with said channels for relieving fluid from within said channels.

7. The drill bit of claim 1, further comprising secondary cutting means secured to said body and positioned to prevent interference of said secondary cutting means with movement of said movable cutting means.

8. The drill bit of claim 1, wherein said body has a central opening formed therein between said cutting means, said opening being sized for receiving a core of formation material therethrough cut by said cutting means.

9. The drill bit of claim 1, wherein said body has rail means associated therewith for retaining said movable cutting means in slidable relationship to said body.

10. The drill bit of claim 9, further comprising intervention means associated with said rail means for limiting movement of said movable cutting means.

11. The drill bit of claim 1, wherein said movable cutting means is rotationally movable with respect to said body.

12. The drill bit of claim 11, further including means for rotationally moving said cutting means toward said second position responsive to contact of said drill bit with an undrilled subterranean formation ahead of said drill bit.

13. A drill bit for drilling subterranean formations, comprising:

a tapered body having an outer diameter, a nose, and channel means formed therein sized to receive at least a portion of a cutting means;

movable cutting means for cutting said formations, at least a portion of said cutting means being slidably disposed within said channel means, said movable cutting means being variably positionable between a first position effecting a first diameter for said cutting means and a second position effecting a second, larger diameter for said cutting means;

slots formed in said cutting means;

positioning pins positioned through said body, said channels and said slots, said slots being slidable over said positioning pins; and cutting elements associated with said cutting means.

14. The drill bit of claim 13, wherein said cutting elements are diamond cutting elements.

15. The drill bit of claim 13, wherein said cutting elements are carbide cutting elements.

16. The drill bit of claim 13, further comprising secondary cutting means secured to said nose of said body, said secondary cutting means having cutting elements associated therewith.

17. The drill bit of claim 13, further comprising relief aperture means associated with said channel means for relieving fluid from within said channel means.

18. A method for drilling a hole within an earth formation comprising: providing a drill bit having:

a body having an outer diameter and a nose positioned therebelow;

movable cutting means slidably associated with said body for cutting said earth formation, said movable cutting means being variably positionable between a first position relatively close to said nose and effecting a first diameter for said cutting means and a second position relatively farther from said nose effecting a second, larger diameter for said cutting means; and cutting elements associated with said cutting means;

placing said drill bit down a hole formed in said earth formation with said cutting means in said first position;

contacting the bottom of said hole with said cutting means and expanding said cutting means away from said nose and into said second position responsive to said contact; rotating said drill bit to cut further into said earth formation; and raising said drill bit from the bottom of said hole and retracting said cutting means to said first position.

19. The method according to claim 18, wherein said body of said drill bit has channels formed therein and wherein said expansion of said cutting means comprises sliding movement of said cutting means within said channels responsive to said cutting means contacting said bottom of said hole.

20. The method according to claim 19, wherein said body of said drill bit further includes secondary cutting means fixedly secured to said body, said secondary cutting means having cutting elements associated therewith.

21. The method according to claim 20, wherein said body of said drill bit further includes a central opening located between said expanded cutting means, said opening being sized to receive a core of earth material excised by said secondary cutting means.

* * * * *